US010980098B2

(12) United States Patent
Katz et al.

(10) Patent No.: US 10,980,098 B2
(45) Date of Patent: Apr. 13, 2021

(54) SYSTEMS AND METHODS FOR ALLOCATING A NETWORK ADDRESS TO A LIGHTING DEVICE

(71) Applicant: Current Lighting Solutions, LLC, East Cleveland, OH (US)

(72) Inventors: Gergely Katz, Budapest (HU); Tamas Varjasi, Budapest (HU); Tamas Vegh, Budapest (HU); Balazs Bencze, Budapest (HU); Sandor Polyak, Budapest (HU)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/102,950

(22) Filed: Aug. 14, 2018

(65) Prior Publication Data

US 2019/0342977 A1 Nov. 7, 2019

Related U.S. Application Data

(60) Provisional application No. 62/667,504, filed on May 5, 2018.

(51) Int. Cl.

| | |
|---|---|
| ***H05B 47/18*** | (2020.01) |
| ***H05B 47/19*** | (2020.01) |
| ***H05B 45/10*** | (2020.01) |

(52) U.S. Cl.

CPC ..... *H05B 47/18* (2020.01); *H05B 45/10* (2020.01); *H05B 47/19* (2020.01)

(58) Field of Classification Search

CPC ..... H05B 37/02; H05B 37/0209; H05B 37/0245; H05B 37/0254; H05B 37/0272; H05B 47/10; H05B 47/175; H05B 47/18; H05B 47/185; H05B 47/19; H05B 45/10

See application file for complete search history.

(56) References Cited

U.S. PATENT DOCUMENTS

| | | | | |
|---|---|---|---|---|
| 7,623,042 | B2 | 11/2009 | Huizenga et al. | |
| 7,748,878 | B2 | 7/2010 | Lee et al. | |
| 8,214,061 | B2 * | 7/2012 | Westrick, Jr. ..... | H05B 47/18 700/9 |
| 8,450,670 | B2 * | 5/2013 | Verfuerth ..... | H05B 47/19 250/205 |
| 8,536,984 | B2 * | 9/2013 | Benetz ..... | H05B 47/10 340/12.28 |
| 8,823,277 | B2 | 9/2014 | Chemel et al. | |

(Continued)

*Primary Examiner* — Jason Crawford

(74) *Attorney, Agent, or Firm* — Buckley, Maschoff & Talwalkar LLC

(57) ABSTRACT

A networked light control system includes a wireless detection circuit configured to receive wireless signals emitted by marker devices associated with different lighting devices. The control system includes the lighting devices connected with each other in a wired lighting control network. The control system includes a controller configured to determine network addresses of the lighting devices in the wired lighting control network based on the wireless signals received from the marker devices. The control system includes the controller is configured to control operation of one or more of the lighting devices in the wired lighting control network using one or more of the network addresses that are determined based on the wireless signals received from the marker devices.

20 Claims, 3 Drawing Sheets

(56) References Cited

U.S. PATENT DOCUMENTS

| | | | | |
|---|---|---|---|---|
| 9,072,133 | B2 | 6/2015 | Chemel et al. | |
| 9,192,032 | B2 | 11/2015 | Kwag et al. | |
| 9,392,675 | B2 * | 7/2016 | Taipale | H05B 47/11 |
| 2006/0125426 | A1 * | 6/2006 | Veskovic | H05B 47/18 315/312 |
| 2008/0183337 | A1 * | 7/2008 | Szabados | H05B 47/16 700/296 |
| 2012/0091896 | A1 * | 4/2012 | Schenk | H04B 10/116 315/132 |
| 2012/0306621 | A1 * | 12/2012 | Muthu | H05B 47/19 340/8.1 |
| 2013/0154513 | A1 | 6/2013 | Mills et al. | |
| 2013/0264971 | A1 | 10/2013 | Yeh et al. | |
| 2014/0265863 | A1 * | 9/2014 | Gajurel | H05B 45/10 315/131 |
| 2016/0360595 | A1 * | 12/2016 | Joppi | H05B 47/105 |
| 2017/0156195 | A1 * | 6/2017 | Shepherd | H05B 47/18 |
| 2017/0238401 | A1 * | 8/2017 | Sadwick | F21V 21/15 315/294 |
| 2017/0245351 | A1 * | 8/2017 | Leinen | H05B 47/11 |
| 2018/0027631 | A1 | 1/2018 | Turvy, Jr. et al. | |
| 2018/0027636 | A1 | 1/2018 | Turvy, Jr. et al. | |
| 2018/0332692 | A1 * | 11/2018 | Feil | H05B 47/19 |

* cited by examiner

SYSTEMS AND METHODS FOR ALLOCATING A NETWORK ADDRESS TO A LIGHTING DEVICE

BACKGROUND

During installation of a lighting system, all fixtures are assigned a network address. However, the network addresses are unknown by the installer of the lighting system. The installer must collect the network addresses and match them to the physical location of one or more light devices. For example, the installer must individually go to each of the one or more light devices to determine and/or identify the network addresses. The need to go to each of the one or more light devices is inefficient and increases an amount of time to install the lighting system.

BRIEF DESCRIPTION

In one embodiment, an apparatus is provided. The apparatus includes a wireless detection circuit configured to detect wireless marking signals received by one or more marker devices that are connected to light devices. The light devices are connected with each other in a lighting control network. The wireless signals admitted by the marker devices indicate network addresses of the light devices within the lighting control network. One or more processors are configured to allocate the light devices among different light control groups based on the network addresses that are wirelessly received by the wireless detection circuit.

In one embodiment, a method to allocate a network address to at least one lighting device is provided. The method includes receiving a network address from one or more marker devices from at least one lighting fixture relative to the room of a floor plan. The method includes allocating the at least one lighting device based on the network address to a lighting control group. The method includes assigning individual matching of the network address with the at least one light device.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
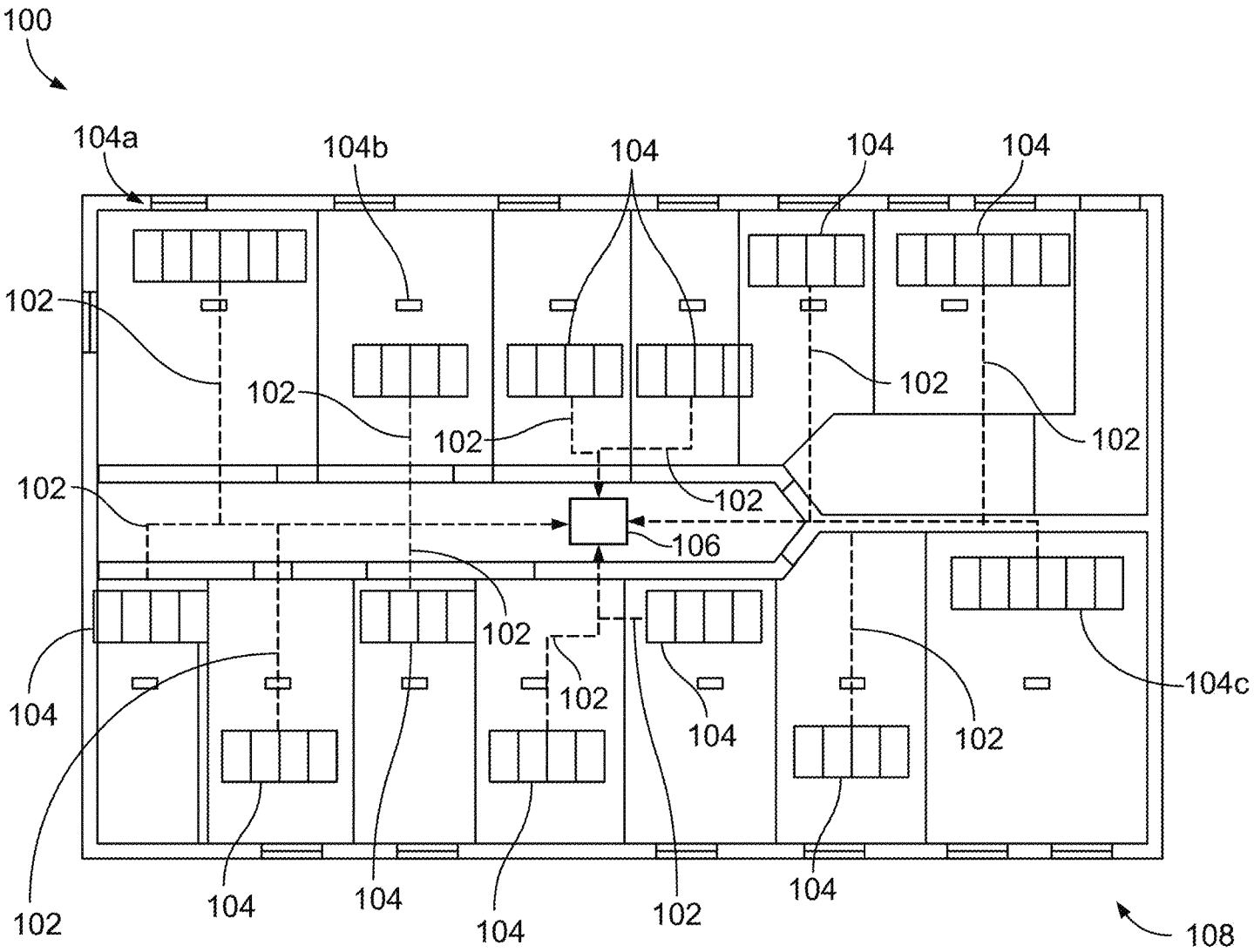
FIG. 1 illustrates a floor plan of a lighting control network, in accordance with an embodiment described herein.

Conventional systems may require the installer of a lighting system to identify network addresses for each lighting device. The installer can be required to move to each lighting device to identify the network address of the lighting device. For example, the installer can establish a wired connection between each lighting device and a computer device. The computer device detects the network address of the lighting device via the wired connection. This process may be repeated for each of several lighting devices in a room, building, or the like.

The systems and methods described herein utilize wireless interfaces to determine the network addresses of lighting devices. Marker or beacon devices are conductively coupled with each lighting device in a wired network of the lighting devices. The marker devices determine the network addresses of the lighting devices. In one embodiment, a marker device determines the network address or addresses of only those lighting devices that are within a designated spatial range of the marker device or that are conductively coupled with the marker device via one or more wired connections. For example, each marker device can determine the network address or addresses of the spatially closest lighting device or devices (e.g., the lighting device or devices located the shortest distance to the marker device), such as those lighting devices in the same room or within a few meters of the marker device. Alternatively, the marker device can be programmed with or otherwise provided with the network addresses of the lighting devices.

Several marker devices can be programmed with or otherwise determine the network addresses of associated lighting devices in a network having the lighting devices spread out over a large area. A marker device can be associated with a lighting device when the marker device has the network address of the lighting device and/or wirelessly communicates the network address of the lighting device. A large ballroom, a building having many floors, a building having many rooms, and/or the like, can have many lighting devices wired with each other in a network. The marker devices can wirelessly communicate (e.g., broadcast or transmit) the lighting devices associated with the marker devices so that each marker device wirelessly communicates the network addresses of the lighting devices near the marker device.

The marker devices may not wirelessly communicate the network addresses of other lighting devices that are not near the marker devices. For example, a marker device in a first room can wirelessly broadcast the network addresses of those lighting devices located in the same first room, but not the network address of any lighting device in any other room. Another marker device in a second room can wirelessly broadcast the network addresses of those lighting devices located in the same second room, but not the network address of any lighting device in any other room, including the first room.

An electronic device having a wireless communication circuit, such as an antenna and receiving circuitry, can detect the wireless signals communicated by the marker devices. This electronic device can be a hand-held or otherwise portable and mobile device. The wireless range of a marker device can be limited so that the wireless signal broadcast by the marker device is only detected by the electronic device while the electronic device is close to the marker device, such as in the same room as the marker device, within a few meters of the marker device, etc.

An installer or another user can move around with the electronic device to detect the wireless signals broadcast by different markers in different locations. The electronic device can receive the wireless signals and extract the network addresses of the lighting devices associated with the different marker devices while the electronic device is within the wireless range of each marker device. For example, the electronic device can detect the network addresses of the lighting devices in the first room from the wireless signal emitted by the marker device in the first room, but not the network address of a lighting device outside of the first room. Similarly, the electronic device can detect the network addresses of the lighting devices in the second room from the wireless signal emitted by the marker device in the second room, but not the network address of a lighting device outside of the second room.

The electronic device or the user of the electronic device can determine the area or locations in which the different network addresses are wirelessly received by the electronic device. This can occur without the electronic device communicating with any lighting device via the network or a wired connection. For example, the electronic device need not be communicatively coupled with the network of lighting devices, with any lighting device, or with any marker device to determine the network addresses of the lighting devices. The installer or other user of the electronic device can move around the locations having the lighting devices and markers, and determine the network addresses of the lighting devices near the electronic device in the different locations In one embodiment, a lighting system controller includes hardware circuitry that includes and/or is connected with one or more processors that assign different lighting devices in the same network to different control groups based on where the electronic device is or was located when the network addresses of the lighting devices were determined from the wireless marker signals. For example, the lighting system controller can create different lighting control groups that include the lighting devices located in different rooms of a floor plan. The lighting system controller can then control (e.g., automatically or under direction of one or more users) which group(s) of lighting devices are activated or deactivated at different times based on the network addresses of the lighting devices and the different locations of the lighting devices.

FIG. 1 illustrates a floor plan 108 of a lighting control network 100. The lighting control network 100 includes a plurality of lighting devices 104 connected with each other by wired connections. The lighting devices 104 can be controlled (individually and/or in groups) to generate light. Non-limiting examples of lighting devices 104 include light emitting devices, fluorescent lamps, incandescent lamps, and/or the like. The lighting devices 104 can be located in different rooms in the floor plan 108. The network formed by the connected lighting devices 104 is a digital addressable lighting interface (DALI) network in one embodiment. Alternatively, the network formed by the connected lighting devices 104 can be another type of network.

Each lighting device 104 in the network can have a different, or unique, address. This network address can allow for a lighting system controller to individually activate or deactivate different lighting devices 104 and to activate or deactivate lighting devices 104 in a selected group of lighting devices 104. For example, control signals issued by a lighting system controller (described below) can be addressed to individual and/or groups of lighting devices 104 using the network addresses of the lighting devices 104. The control signals can be communicated through the conductive pathways (e.g., wires, buses, or the like) that connect the lighting devices 104 in the lighting control network. The lighting devices 104 having network addresses identified by or the control signals receive the control signals and change operation in response thereto (e.g., activate responsive to receiving a control signal that directs the lighting device 104 to turn on or deactivate responsive to receiving a control signal that directs the lighting device 104 to turn off).

Figure 2:
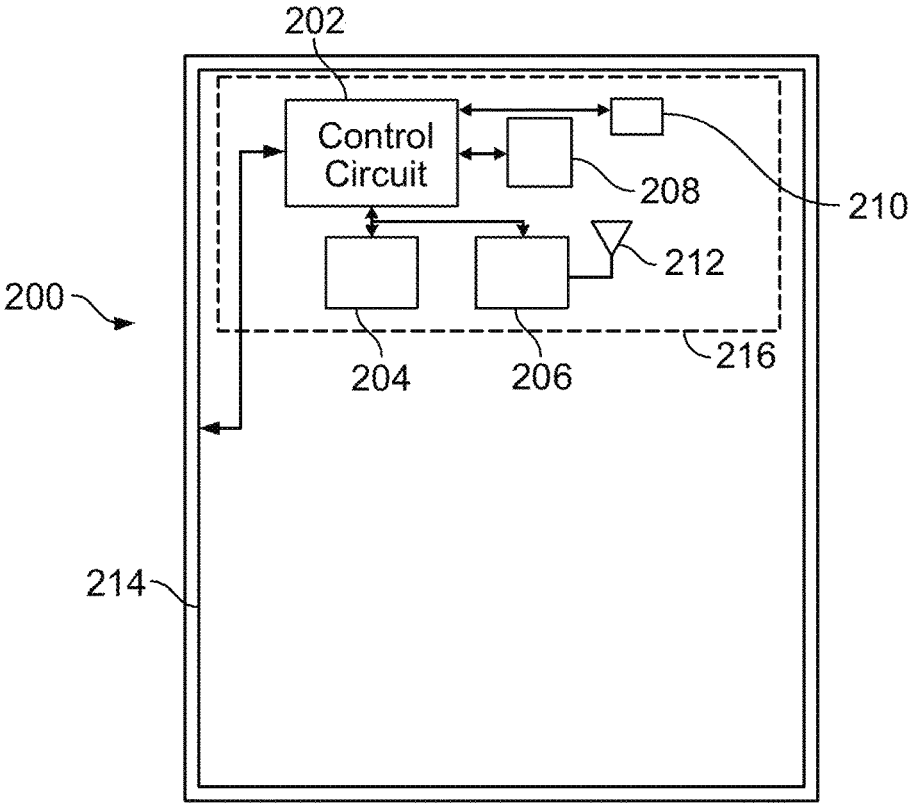
FIG. 2 illustrates a schematic view of a lighting system controller, in accordance with an embodiment described herein.

FIG. 2 illustrates a schematic view of a lighting system controller 200. The controller 200 represents a portable mobile device that can be carried by an installer of the lighting control network 100 to wirelessly identify the network addresses of the lighting devices 104 in the network 100. For example, the controller 200 includes at least one of a tablet, a mobile phone, a smartphone, a laptop, and/or the like. The controller 200 includes a control circuit 202 that includes and/or represents hardware circuitry that includes, is connected with, or that both includes and is connected with one or more processors, controllers, or other hardware logic-based devices (e.g., application specific integrated circuit, field programmable array, and/or the like). Additionally or alternatively, the control circuit 202 may execute instructions stored on a tangible and non-transitory computer readable medium (e.g., memory 208) to perform one or more operations as described herein. The controller 200 optionally can include a display 214 that presents information to the installer that is using the controller 200.

The control circuit 202 is operably coupled to or includes a wireless detection circuit 206. The wireless detection circuit 206 includes hardware circuitry that can wirelessly communicate with one or more other devices. For example, the wireless detection circuit 206 can include one or more antenna 212 and/or receiving (or transceiving) circuitry that receives wireless signals 102 emitted by marker devices (described herein). The wireless detection circuit 206 is configured to communicate with the one or more marker devices using one or more different wireless techniques, such as Wi-Fi, Bluetooth, Zigbee, wireless USB, radio frequency identification, Z-wave, ultra-wideband, and/or the like.

In one embodiment, the control circuit 202 includes or is coupled with a location-determining device 210. The location-determining device 210 can identify spatial locations of the controller 200. For example, the location-determining device 210 can include a proximity sensor, an ambient light sensor, a Global Position System (GPS) sensor, circuitry that wirelessly triangulates locations of the controller 200, and/or the like. The spatial location of a lighting device 104 can be the geographic location of the lighting device 104, an identification of a room in which the lighting device 104 is located, an identification of a section of a room in which the lighting device 104 is located (e.g., the northwest corner of the room), coordinates of the lighting device 104, or another identification of where the lighting device 104 is located.

The location-determining device 210 can be used to determine a location of the controller 200 is located as the installer moves around the floor plan 108 with the controller 200 to wirelessly determine the network addresses of the lighting devices 104. For example, as the installer walks into a room with the controller 200, the location-determining device 210 can determine the location of the location-determining device 210 in that room to assist with identifying which lighting devices 104 are located in that room (based on the network addresses that are wirelessly received by the controller 200, as described herein). Alternatively, the control circuit 202 may not include or may not use the location-determining device 210 in certain operations. For example, the installer can manually input the location of the control circuit 202 when identifying the lighting devices 104 in a location, such as via a touchscreen of the controller 200 or another input device.

Optionally, the control circuit 202 may be a system on chip (SoC) 216. The SoC 216 includes one or more processors, digital circuitry, an analog array, the memory 208, and/or a mixed signal array. The SoC 216 may include the touchscreen control circuit 204, the wireless detection circuit 206, and/or the like. The SoC 216 may be embedded on a single die contained within a single chip package (e.g., a quad flat no-leads package (QFN), a thin quad flat package (TQFP), a small outline integrated circuit (SOIC), a ball grid array (BGA), and/or the like).

Figure 3:
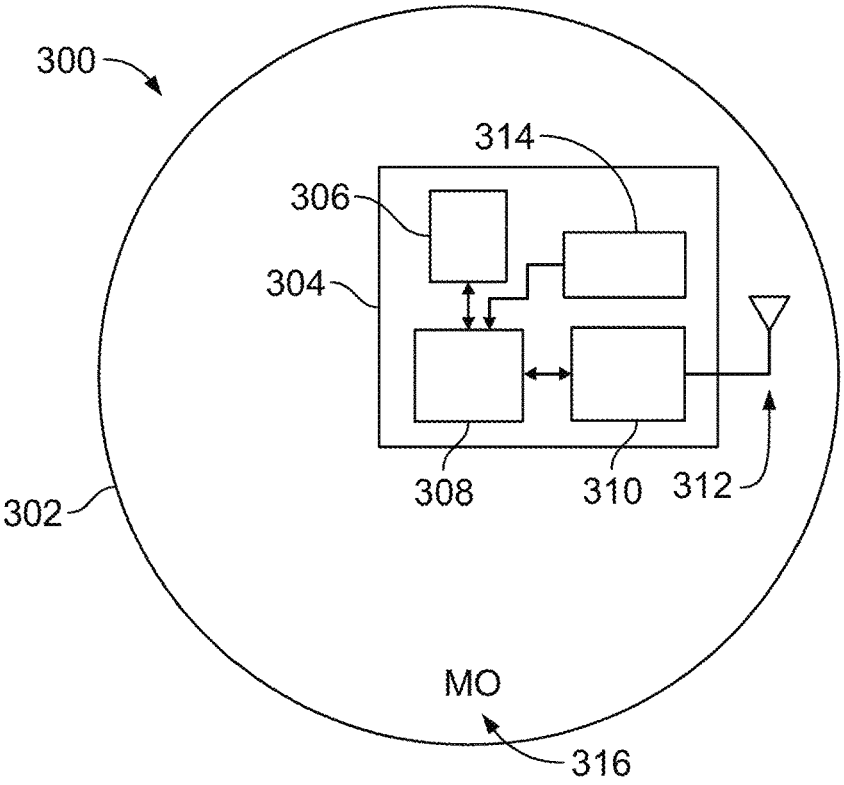
FIG. 3 illustrates a schematic view of a marker device, in accordance with an embodiment described herein.

FIG. 3 illustrates a schematic view of a marker device 300. As described above, the marker device 300 determines or is provided with the network address of one or more lighting devices 104 in the lighting control network 100. For example, the marker device 300 can be communicatively coupled with a lighting device 104 by one or more wires, buses, or the like, and can communicate with the lighting device 104 via or over this wired connection. This communication can provide the marker device 300 with the network address of the lighting device 104, such as by the lighting device 104 sending a signal to the marker device 300 that provides or otherwise identifies the network address.

The marker device 300 can be enclosed within a housing 302 that is separate from the lighting device 104 with which the marker device 300 is associated. Alternatively, the marker device 300 can be enclosed in a housing 302 that is separate from the lighting device 104 with which the marker device 300 is associated. The housing 302 is shown having a circular shape but may have another shape, such as a rectangular shape, a triangle shape, a trapezoid shape, and/or the like. The marker device 300 includes a wireless detection circuit 304 that can wirelessly communicate the network address of the lighting device 104 with which the marker device 300 is associated. The wireless detection circuit 304 can include a wireless interface 310 having one or more processors 308, an antenna 312, and transceiving or transmitting circuitry to transmit, broadcast, or otherwise wirelessly emit the network address of the lighting device 104.

The components of the marker device 300 can be powered by a local power supply 314. The power supply 314 may include at least one of a rechargeable battery, such as a lithium-ion battery, a lithium-ion polymer battery, and/or the like. Optionally, the components of the marker device 300 can be powered via current supplied through the network 100 or via separate connection to a utility grid. The marker device 300 can include a tangible and non-transitory computer-readable memory 306 that can store the network address of the lighting device 104 associated with the marker device 300.

Optionally, the marker device 300 includes an identification marker 316. The identification marker 316 may correspond to a network address for the DALI network. For example, the identification marker 316 may display the different network addresses of the lighting devices 104 for the DALI network. Additionally or alternatively, the identification marker 316 may include a display. The display is configured to indicate on the housing 302 the network address of the lighting devices 104 that may include at least one of the MAC address, and/or the like.

The wireless range of the marker device 300 may be spatially limited. In one example, the marker device 300 may only be capable of emitting the wireless signals 102 that identifies the network address of one or more lighting devices 104 to a range that includes the locations of these lighting devices 104, but no other lighting devices 104. As another example, the wireless range of the marker device 300 may be limited to the room in which the lighting device(s) 104 associated with the marker device 300 are located. The limited wireless range of the marker devices 300 can assist the controller 200 in identifying the geographic or spatial locations of the lighting devices 104.

In operation, an installer can move around a building or other facility having several lighting devices 104 and marker devices 300 emitting the network addresses of the lighting devices 104. The installer can carry the controller 200 as the installer moves around, with the controller 200 receiving the wireless signals 102 emitted by the marker devices 300. The controller 200 determines the network addresses of the lighting devices 104 when the controller 200 is in the different wireless ranges of the different marker devices 300 and can identify the spatial or geographic locations of the lighting devices 104. For example, the controller 200 can be in a first room of a building having first through sixth lighting devices 104 and first through sixth associated marker devices 300. Second, third, and fourth rooms in the building may have additional lighting devices 104 and marker devices 300, but the wireless range of the marker devices 300 may be so spatially limited that the wireless signals 102 emitted by other marker devices 300 associated with the lighting devices 104 in other rooms are not received or otherwise detected by the controller 200 while the controller 200 is in the first room.

While in the first room, the controller 200 receives the wireless signals 102 emitted by the marker devices 300 associated with the lighting devices 104 in the first room. The controller 200 determines the network addresses of these lighting devices 104. The controller 200 determines the location of the controller 200 (e.g., in the first room) using the location-determining device 210 and/or based on operator input provided by the installer. The controller 200 can then determine and store (e.g., in the memory 208 of the controller 200) which lighting devices 104 are in the first room and the network addresses of these lighting devices 104. The controller 200 can be moved into other rooms to wirelessly determine the network addresses of other lighting devices 104 and locations of the lighting devices 104.

In one embodiment, the does not associate a different network address with each individual lighting device 104. Instead, the can wirelessly obtain a set of network addresses from several marker devices 300 associated with a group of several lighting devices 104, and the can associate this set of network addresses with the group of lighting devices 104. The may not identify a one-to-one relationship between the network addresses and the lighting devices 104. The can determine that the group of network addresses are associated with the lighting devices 104 in the same room or same proximity (e.g., within fifteen meters of the).

The controller 200 can use these network addresses and locations of the lighting devices 104 to control which lighting devices 104 are activated or deactivated at different times. For example, the controller 200 can activate all lighting devices 104 in the third room by sending control signals (via the lighting control network 100) to those network addresses of the lighting devices 104 identified as being in the third room of the building. Optionally, the controller 200 can provide the network addresses and locations of the lighting devices 104 to another controller that controls operation of the lighting devices 104.

Figure 4:
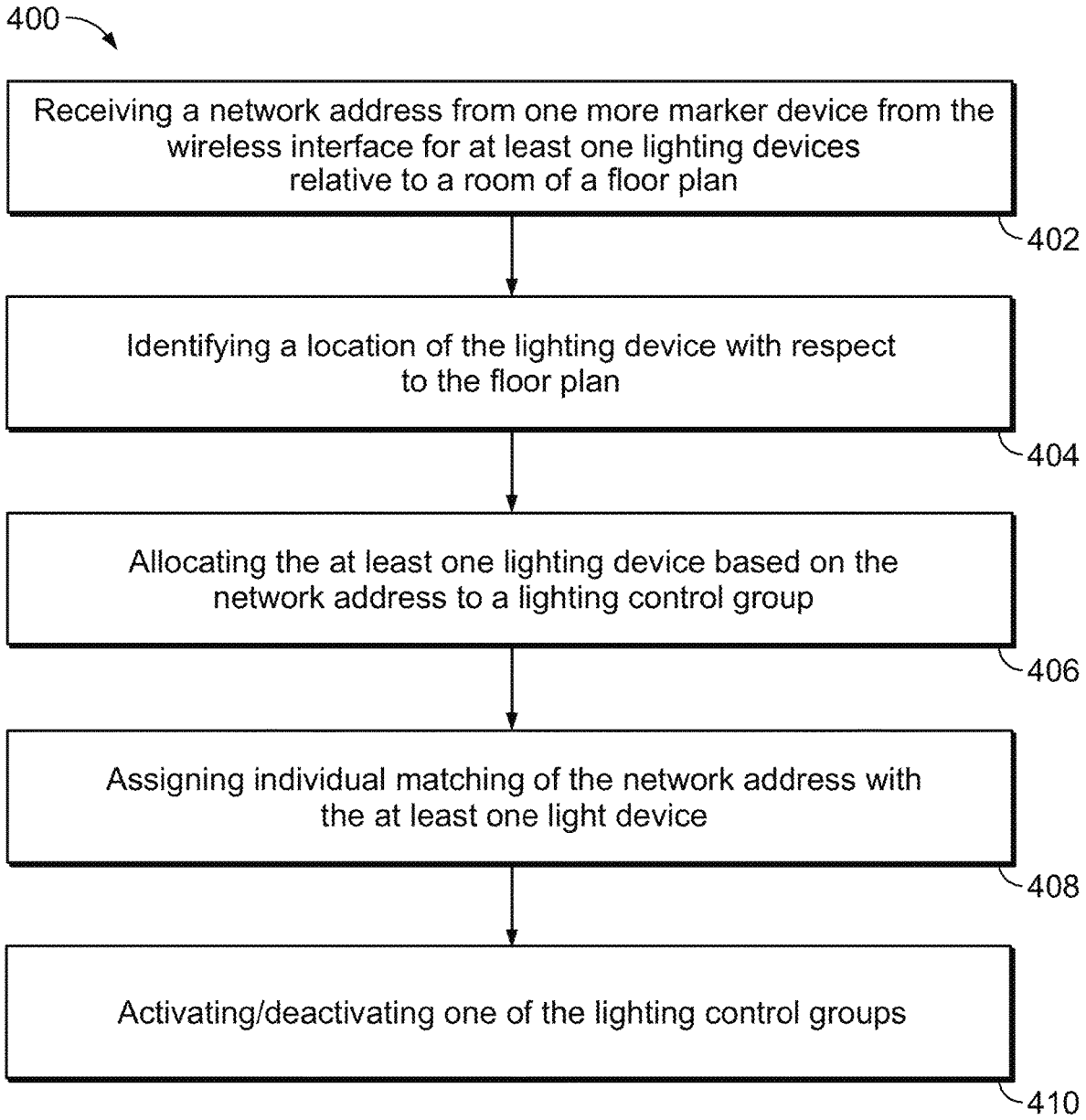
FIG. 4 illustrates a flowchart of one embodiment of a method to allocate a network address to a lighting device, in accordance with an embodiment described herein.

FIG. 4 illustrates a flowchart of one embodiment of a method 400 for wirelessly identifying network addresses of lighting devices in a wired lighting network. The method 400 can represent operations performed by the controller 200.

At 402, a network address is received from one or more marker devices 300 from the wireless interface for at least one lighting device 104 relative to a room of the floor plan 108. For example, the marker devices 300 receive the network addresses from the wireless interface from the wireless detection circuit 304 from a corresponding one of the lighting devices 104 within a room of the floor plan 108. The marker devices 300 transmit/emit the network addresses to the controller 200.

At 404, the controller 200 identifies a location of the lighting device 104 with respect to the floor plan 108. For example, the controller 200 determines a location of the marker devices 300 and/or the controller 200 relative to the floor plan 108. The controller 200 identifies a location of the room with the marker devices 300 within the room relative to the floor plan.

At 406, the control circuit 202 allocates the at least one lighting device 104 based on the network address and a location to a lighting control group. For example, the control circuit 202 receives the network addresses and/or location received from the marker devices 300 and/or the location-determining device 210. The controller 200 allocates the network addresses received form the marker devices 300 into the lighting control group. Optionally, the controller 200 may form the lighting control group based on the network addresses and an associated location. For example, the controller 200 may combine all the marker devices 300 that acquire the network addresses within a common room relative to the floor plan 108 to a corresponding lighting control group. Additionally or alternatively, the controller 200 may allocate a subset of the network addresses to one of the lighting control groups. For example, the controller 200 may separate the marker devices 300 that detect At 408, the control circuit 202 assigns individual matching of the network address with at least one lighting device 104. For example, the control circuit 202 receives the network addresses from the marker devices 300. The control circuit 202 assigns each network address to at least one lighting device 104. For example, the control circuit 202 assigns the network addresses based on the lighting device 104 communicatively coupled to the marker devices 300. The control circuit 202 matches each network address based on the received network address and/or location from the marker devices 300.

At 410, the controller 200 activate/deactivate one of the lighting control groups. For example, the controller 200 controls operation of one or more of the lighting devices 104 in the lighting control network 100 using one or more of the network addresses that are identified based on the signals that are wirelessly received from the marker devices 300. For example, the one of the lighting control groups may be based on the network addresses of the lighting devices 104 and/or the location relative to the floor plan 108.

The controller 200 may activate the one of the lighting control groups. For example, the controller 200 broadcasts a control signal over to the lighting control network 100 using the network addresses of the one of the lighting control groups. The lighting devices 104 are activated by the one or more wired path(s) to the network addresses to implement/effectuate the activation of the lighting devices 104 of the one of the lighting control groups. Optionally, the controller 200 may deactivate the one of the lighting control groups. For example, the controller 200 broadcasts a control signal over to the lighting control network 100 using the network addresses of the one of the lighting control groups. The lighting devices 104 are deactivated by the one or more wired path(s) to the network addresses to cancel/halt the lighting devices 104 of the one of the lighting control groups.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a wireless detection circuit configured to receive wireless signals emitted by marker devices associated with different lighting devices, the lighting devices connected with each other in a wired lighting control network, wherein each of the marker devices is disposed within a marker housing which is physically separate from corresponding housings within which each of the different lighting devices is disposed, and at least one of the marker devices determines separate network addresses for each of at least two lighting devices of the different lighting devices; and a controller configured to determine network addresses of the lighting devices in the wired lighting control network based on the wireless signals received from the marker devices, wherein the controller is separate from each of the markers, wherein the controller is configured to control operation of one or more of the lighting devices in the wired lighting control network using one or more of the network addresses that are determined based on the wireless signals received from the marker devices.

2. The system of claim 1, wherein the controller also is configured to determine spatial locations of the lighting devices based on locations of the controller while the network addresses of the lighting devices are wirelessly received by the controller.

3. The system of claim 2, wherein the wireless signals emitted by the marker devices have a restricted range and the controller is configured to determine the spatial locations of the lighting devices based on the restricted range of the marker devices.

4. The system of claim 1, wherein the lighting devices are wired with each other in a digital addressable lighting interface network.

5. The system of claim 1, wherein the controller is configured to determine the network address for each of the lighting devices based on the wireless signals received from the marker devices.

6. The system of claim 1, wherein the controller is configured to associate a group of the network addresses with a group of the lighting devices without associating each of the network addresses with a different lighting device of the lighting devices.

7. The system of claim 1, wherein the controller is configured to automatically determine the network addresses of the lighting devices without receiving operator intervention that identifies the network addresses.

8. A system comprising:

a wireless detection circuit configured to receive wireless signals emitted by marker devices associated with different lighting devices, the lighting devices connected with each other in a wired lighting control network, wherein each of the marker devices is disposed within a marker housing which is physically separate from corresponding housings within which each of the different lighting devices is disposed; and a controller configured to determine network addresses of the lighting devices in the wired lighting control network based on the wireless signals received from the marker devices, wherein the controller is separate from each of the markers, and at least one of the marker devices determines separate network addresses for each of at least two lighting devices of the different lighting devices, wherein the controller also is configured to determine spatial locations of the lighting devices based on locations of the controller while the network addresses of the lighting devices are wirelessly received by the controller.

9. The system of claim 8, wherein the controller is configured to control operation of one or more of the lighting devices in the wired lighting control network using one or more of the network addresses that are determined based on the wireless signals received from the marker devices.

10. The system of claim 8, wherein the wireless signals emitted by the marker devices have a restricted range and the controller is configured to determine the spatial locations of the lighting devices based on the restricted range of the marker devices.

11. The system of claim 8, wherein the lighting devices are wired with each other in a digital addressable lighting interface network.

12. The system of claim 8, wherein the controller is configured to determine the network address for each of the lighting devices based on the wireless signals received from the marker devices.

13. The system of claim 8, wherein the controller is configured to associate a group of the network addresses with a group of the lighting devices without associating each of the network addresses with a different lighting device of the lighting devices.

14. The system of claim 8, wherein the controller is configured to automatically determine the network addresses of the lighting devices without receiving operator intervention that identifies the network addresses.

15. A method comprising:

wirelessly receiving signals from marker devices associated with lighting devices that are wired together in a lighting control network, wherein each of the marker devices is disposed within a marker housing which is physically separate from corresponding housings within which each of the different lighting devices is disposed;

identifying network addresses of the lighting device based on the signals that are wirelessly received; and controlling operation of one or more of the lighting devices in the lighting control network, via a controller, using one or more of the network addresses that are identified based on the signals that are wirelessly received from the marker devices, wherein the controller is separate from each of the marker devices, and at least one of the marker devices determines separate network addresses for each of at least two lighting devices of the different lighting devices.

16. The method of claim 15, further comprising determining spatial locations of the lighting devices based on locations of the controller that wirelessly receives the signals from the marker devices.

17. The method of claim 16, wherein the signals that are wirelessly emitted by the marker devices have a restricted range, and the spatial locations of the lighting devices are determined based on the restricted range.

18. The method of claim 15, wherein the network addresses that are identified are addresses of a digital addressable lighting interface network.

19. The method of claim 15, wherein the network address is identified for each of the lighting devices based on the signals that are wirelessly received from the marker devices.

20. The method of claim 15, wherein a group of the network addresses is identified for a group of the lighting devices without associating each of the network addresses with a different lighting device of the lighting devices.

* * * * *